US006447387B1

(12) United States Patent
Tseng

(10) Patent No.: US 6,447,387 B1
(45) Date of Patent: Sep. 10, 2002

(54) EXHAUST ASSEMBLY FOR A PNEUMATIC SANDING DEVICE

(76) Inventor: Ming-Qun Tseng, No. 38-11, 10th Neighborhood, Jungieng Li, Yuanli Jen, Miaoli (TW)

( * ) Notice: Subject to any disclaimer, the term of this patent is extended or adjusted under 35 U.S.C. 154(b) by 40 days.

(21) Appl. No.: 09/781,257

(22) Filed: Feb. 13, 2001

(51) Int. Cl.[7] ..... B24B 55/10
(52) U.S. Cl. ..... 451/456; 451/359; 451/451
(58) Field of Search ..... 451/344, 359, 451/451, 456

(56) References Cited

U.S. PATENT DOCUMENTS 1,560,658 A * 11/1925 Bull ..... 29/DIG. 64
2,219,444 A * 10/1940 Eserkaln et al. ..... 29/DIG. 69
5,027,470 A * 7/1991 Takashima ..... 15/385
5,774,992 A * 7/1998 Lindenmuth ..... 30/124
5,919,085 A * 7/1999 Izumisawa ..... 451/356
6,293,321 B1 * 9/2001 Chiang ..... 144/114.1
6,328,643 B1 * 12/2001 Huber ..... 451/357

* cited by examiner

*Primary Examiner*—M. Rachuba
*Assistant Examiner*—David Nguyen
(74) *Attorney, Agent, or Firm*—Rosenberg, Klein & Lee

(57) ABSTRACT

An exhaust assembly of a sanding device includes a first passage and an extension tube which are respectively defined in a hosing of the casing of the sanding device. The hosing has an inlet and an outlet. The first passage communicates with the outlet and inlet, and the extension tube extends from the hosing. The extension tube is engaged with an annular cover which communicates with the sanding pad and has an exhaust tube. A control valve is rotatably received in the first passage to block or open the outlet or the extension tube. A bag or a vacuum cleaner can be connected to the exhaust tube of the annular cover to collect sanding powder or sanding debris.

4 Claims, 14 Drawing Sheets

EXHAUST ASSEMBLY FOR A PNEUMATIC SANDING DEVICE

FIELD OF THE INVENTION

The present invention relates to a pneumatic sander which has an exhaust assembly with a control valve to change the passages in the assembly so as to guide the powder during grinding to desired position.

BACKGROUND OF THE INVENTION

A conventional pneumatic grinding device 10 is shown in FIGS. 1 and 2, and includes an annular cover 17 which is connected to an underside of a body 11 and a motor shaft balancer (not shown) is rotatably received in the body 1. A sanding disk or sanding pad 16 is driven by the motor shaft balancer and located at an underside of the annular cover 17. A block 14 extends radially outward from the body 11 and an inlet 12 and an outlet 13 are respectively defined through the block 14 and communicate with an interior of the body 11. Pressurized air is introduced into the body 1 1 via the inlet 12 and flows out from the outlet 13. A tube 171 extends from the annular cover 17 and a communication tube 18 is connected between the outlet 13 and the tube 171 so that the exhaust air flow will suck the sanding powder from the communication tube 18 and being collected in a bag 181 connected to the outlet 13. FIG. 3 shows another type of sanding powder collection system and includes an auxiliary tube 19 which has a collar 190 mounted to the block 14 and a seal 191 seals the outlet 13. The auxiliary tube 19 is connected to the tube 171 and has an open end which is connected to a hose of a vacuum cleaner 192. By this way, the sanding powder is sucked by the vacuum cleaner 192 via the auxiliary tube 19. Therefore, the sanding device has three way to deal with the sanding powder, one of which is to blow the power from the outlet 13 together with the exhaust air flow, the second is to cooperate with a bag 181 as shown in FIG. 2, and the third way is to connect a vacuum cleaner 192 as shown in FIG. 3 to suck the power. The users have to choose specific items to be connected to the block 14 or the tube 171 whichever the bag 18 or the vacuum cleaner 192 are to be used. Each way of collecting the sanding powder involves a lot of parts and takes time to install or disengage from the sanding device.

The present invention intends to provide an exhaust assembly that has a control valve which is rotated to change the passages to let the exhaust air flow go through the designated passage.

SUMMARY OF THE INVENTION

In accordance with one aspect of the present invention, there is provided an exhaust assembly of a sanding device and comprising an annular cover mounted to the motor shaft balancer and a sanding pad is connected to the motor shaft balancer. An exhaust tube extends from the annular cover and holes are defined in the sanding pad and communicate with an interior of the annular cover. A casing is engaged with the annular cover and a hosing extends from the casing. An inlet and an outlet are respectively defined through the hosing and communicate with an interior of the casing. A first passage is defined in the hosing and communicates with the aid inlet and the outlet. An extension tube extends from the hosing and communicates with the first passage and the outlet. The extension tube is engaged with the annular cover. A control valve is rotatably received in the first passage and has a first section and a second section. A through hole is defined radially through the first section and a notch is defined in an outer periphery of the second section. The first section is located to block the extension tube and the second section is located to block the outlet.

The primary object of the present invention is to provide an exhaust assembly for a sanding device wherein the sanding device can be cooperated with a dust bag or a vacuum cleaner by rotating the control member.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
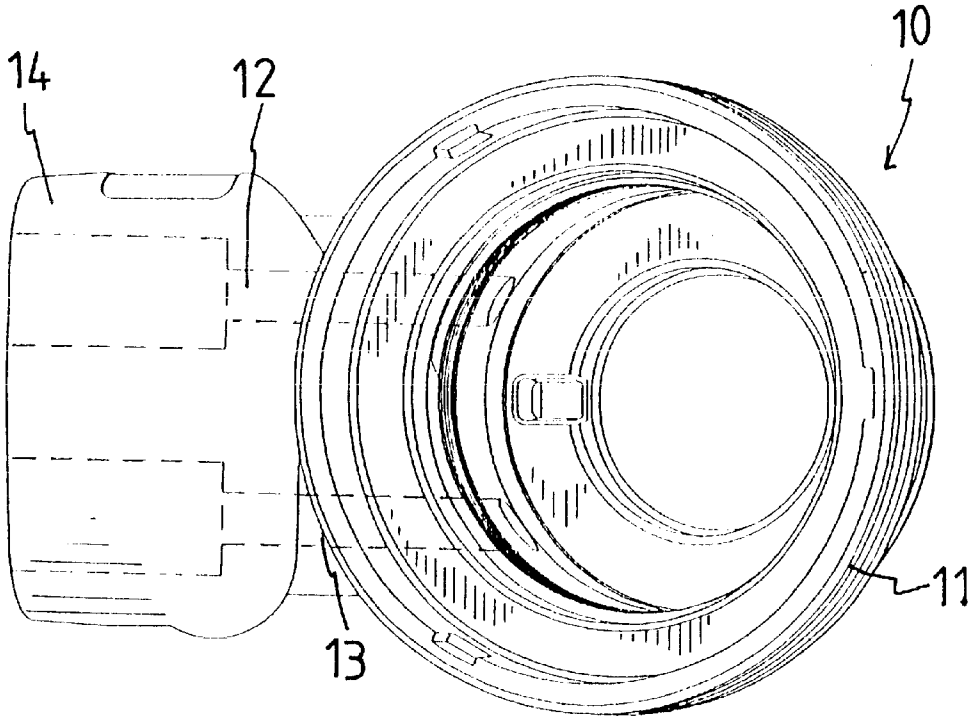
FIG. 1 PRIOR ART
FIG. 1 is a bottom view to show a conventional casing of a sanding device.
Figure 2:
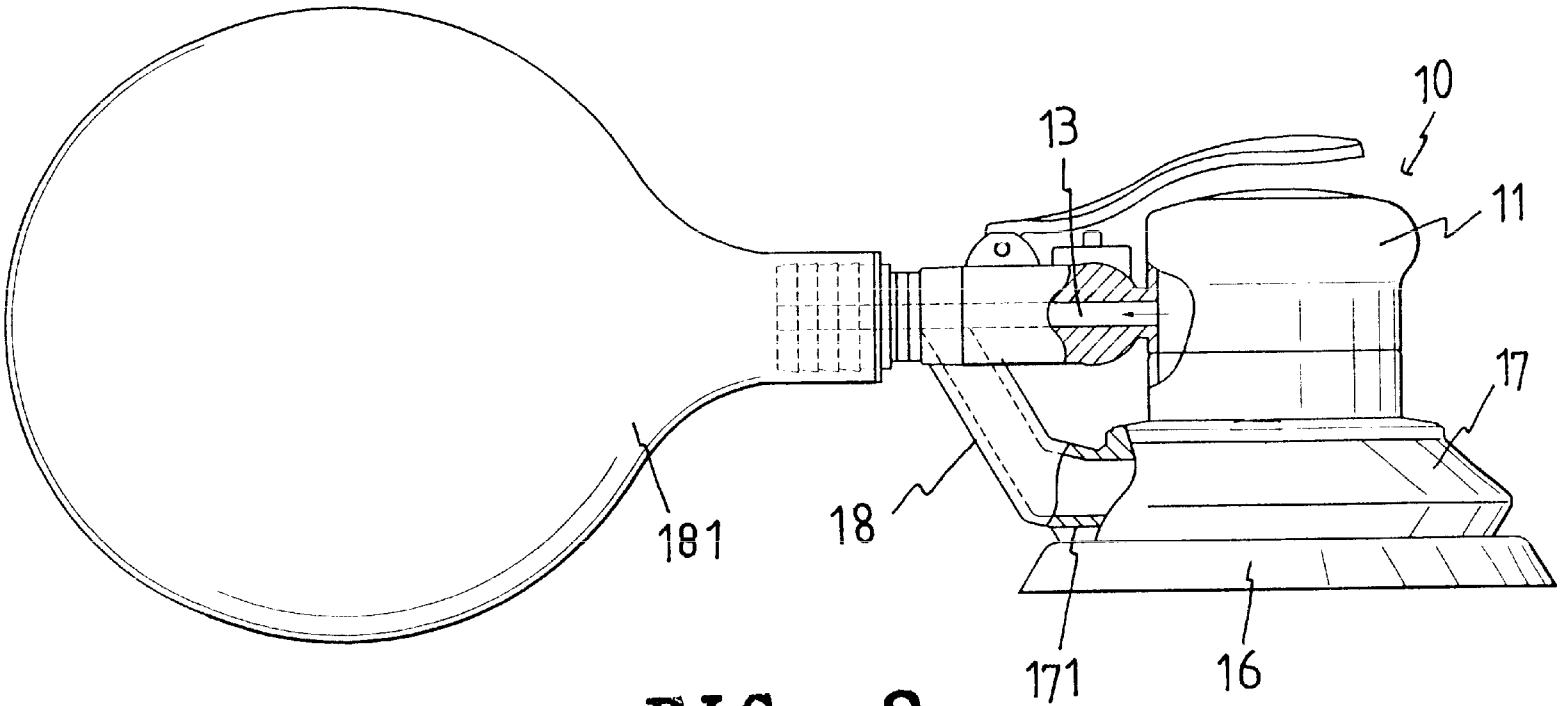
FIG. 2 PRIOR ART
FIG. 2 is a cross sectional view to show a dust bag is connected to the conventional sanding device.
Figure 3:
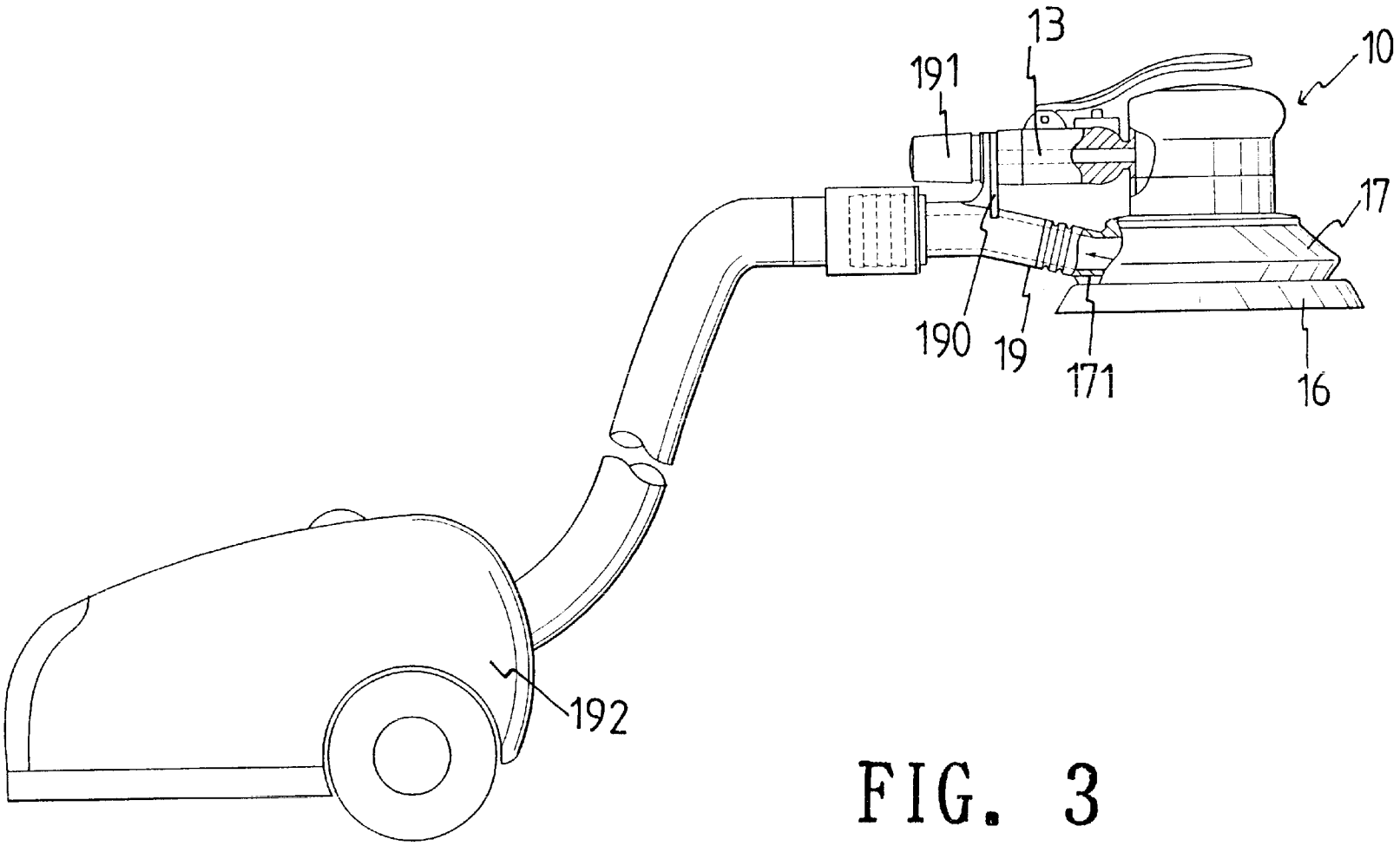
FIG. 3 PRIOR ART
FIG. 3 is a cross sectional view to show a vacuum cleaner is connected to the conventional sanding device.
Figure 4:
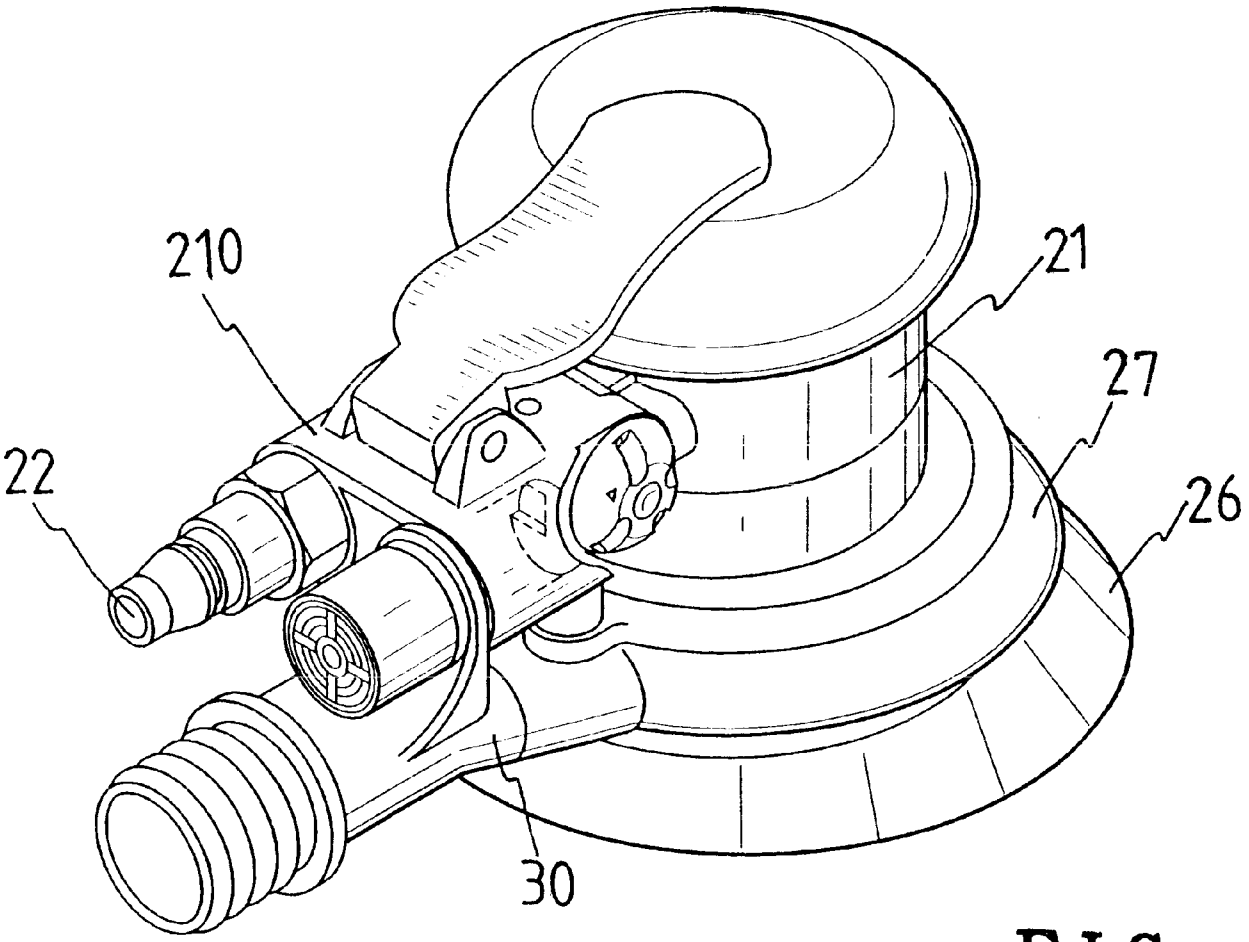
FIG. 4 is a perspective view to show the exhaust assembly and the sanding device of the present invention.
Figure 5:
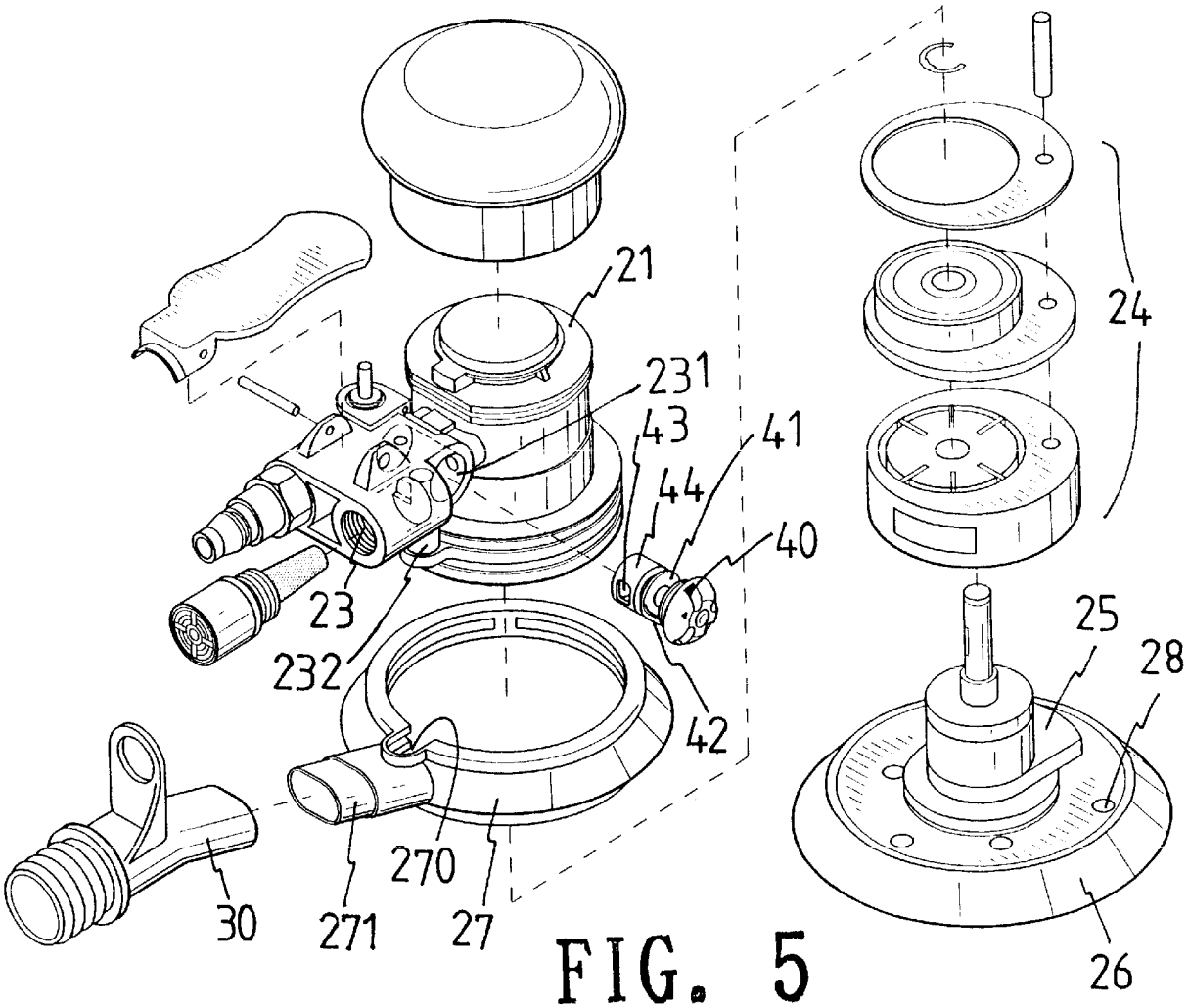
FIG. 5 is an exploded view to show the exhaust assembly and the sanding device of the present invention.

Referring to FIGS. 4 and 5, the sanding device of the present invention comprises a sanding pad 26 connected to an underside of a motor shaft balancer 25 and a power assembly 24 connected to a top of the motor shaft balancer 25. The sanding pad 26 has holes 28 defined therethrough and an annular cover 27 is mounted to the motor shaft balancer 25, wherein the holes 28 communicate with an interior of the annular cover 27. An exhaust tube 271 extends from the annular cover 27 and an engaging recess 270 is defined in an inner periphery of a top of the annular cover 27 so that the engaging recess 270 communicates with the exhaust tube 271. The sanding pad 26 is connected to the annular cover 27 and exposed to an underside of the annular cover 27.

Figure 11:
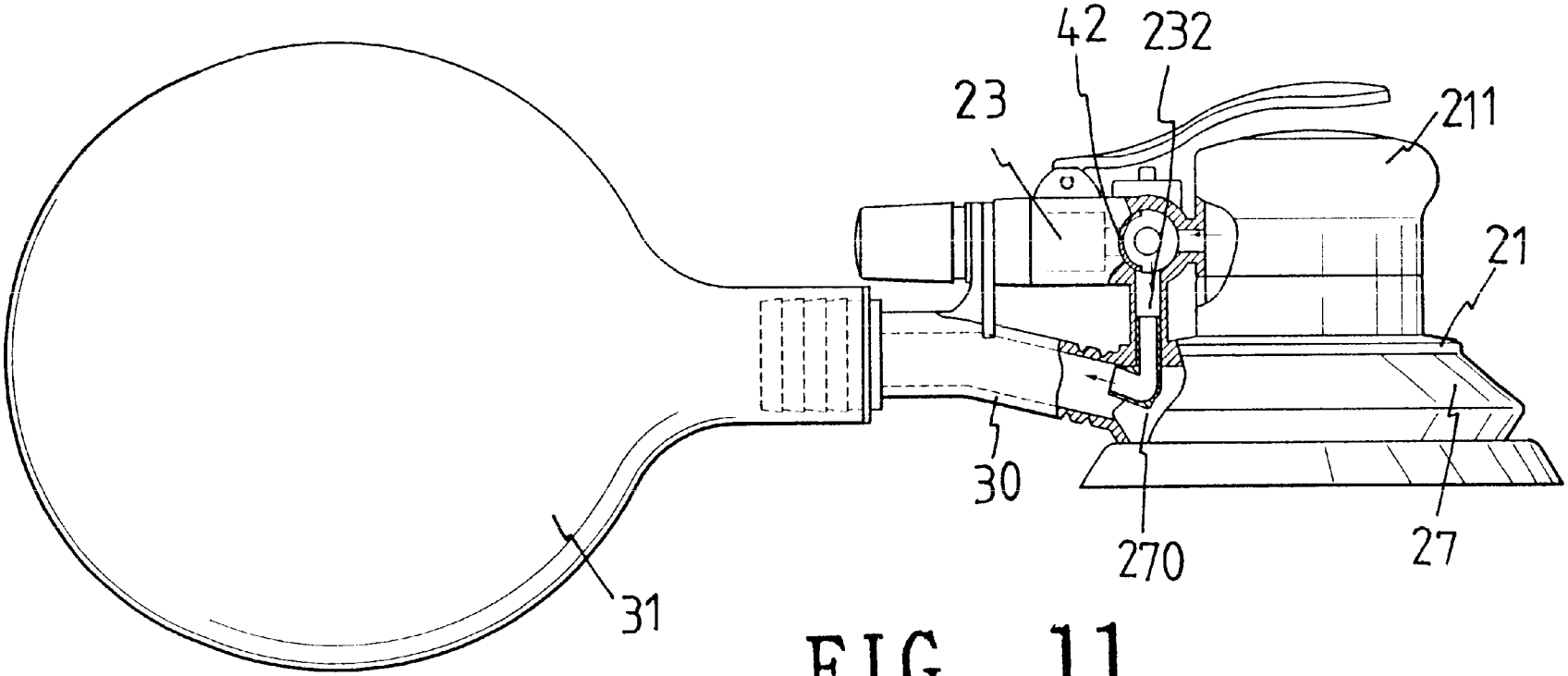
FIG. 11 is a cross sectional view to show a dust bag is connected to the collection tube on the exhaust tube and the connection member is received in the extension tube.
Figure 12:
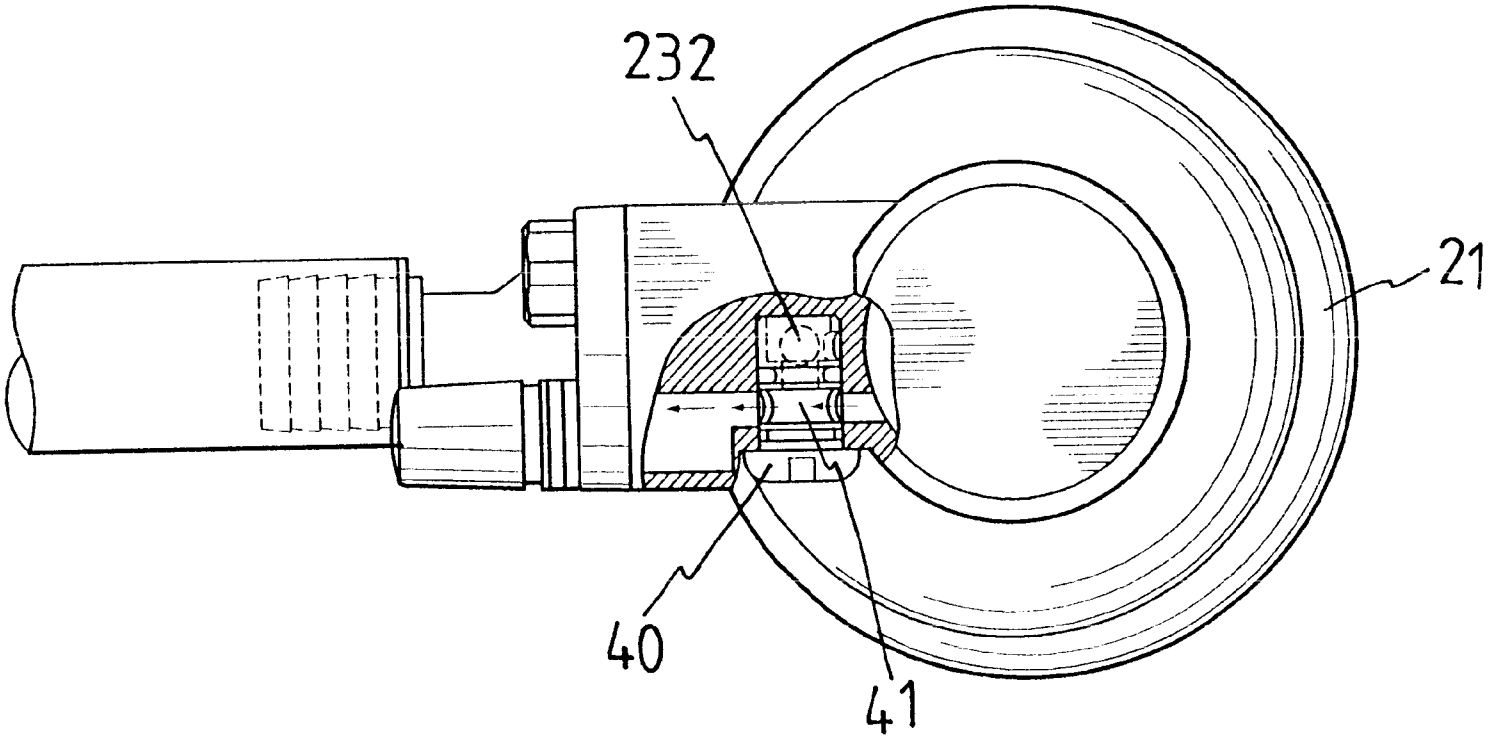
FIG. 12 is a top cross sectional view to show the control member is positioned to block the extension tube and the outlet.
Figure 13:
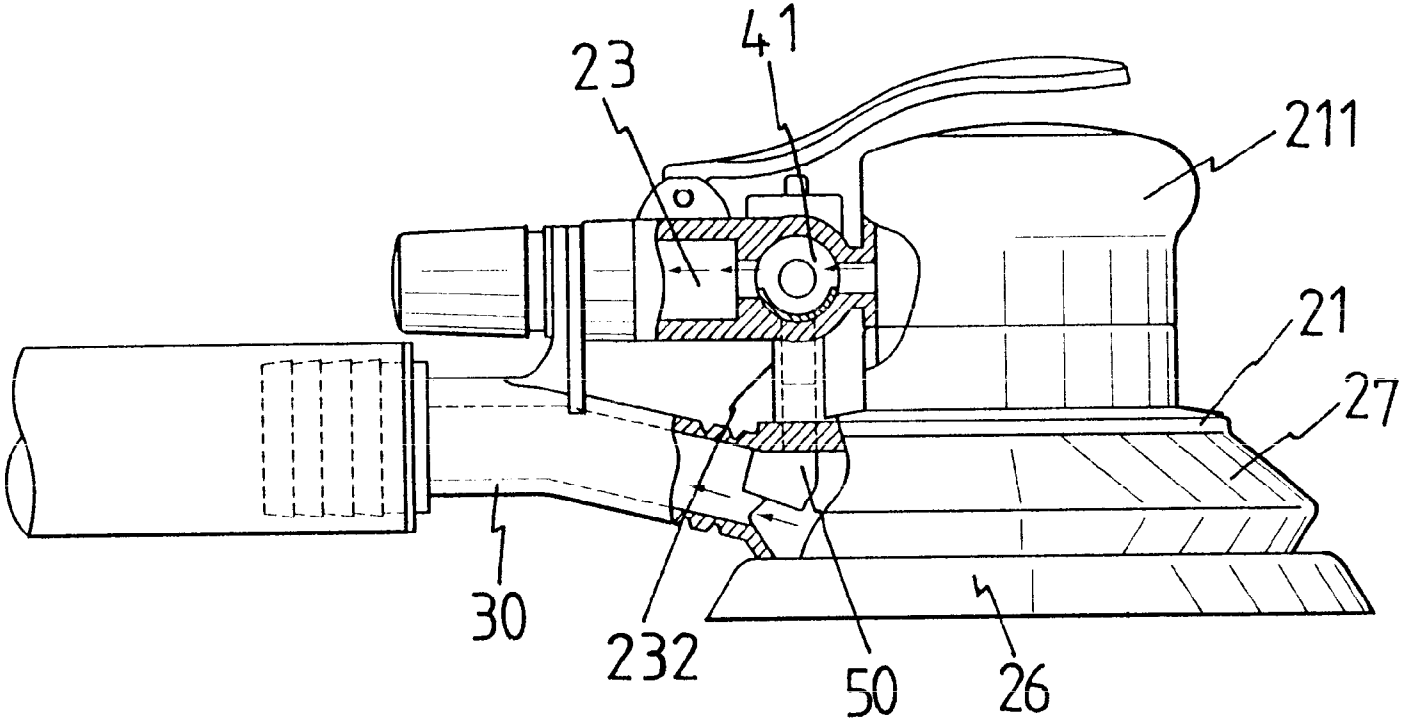
FIG. 13 is a side cross sectional view to show the situation as illustrated in FIG. 12.
Figure 14:
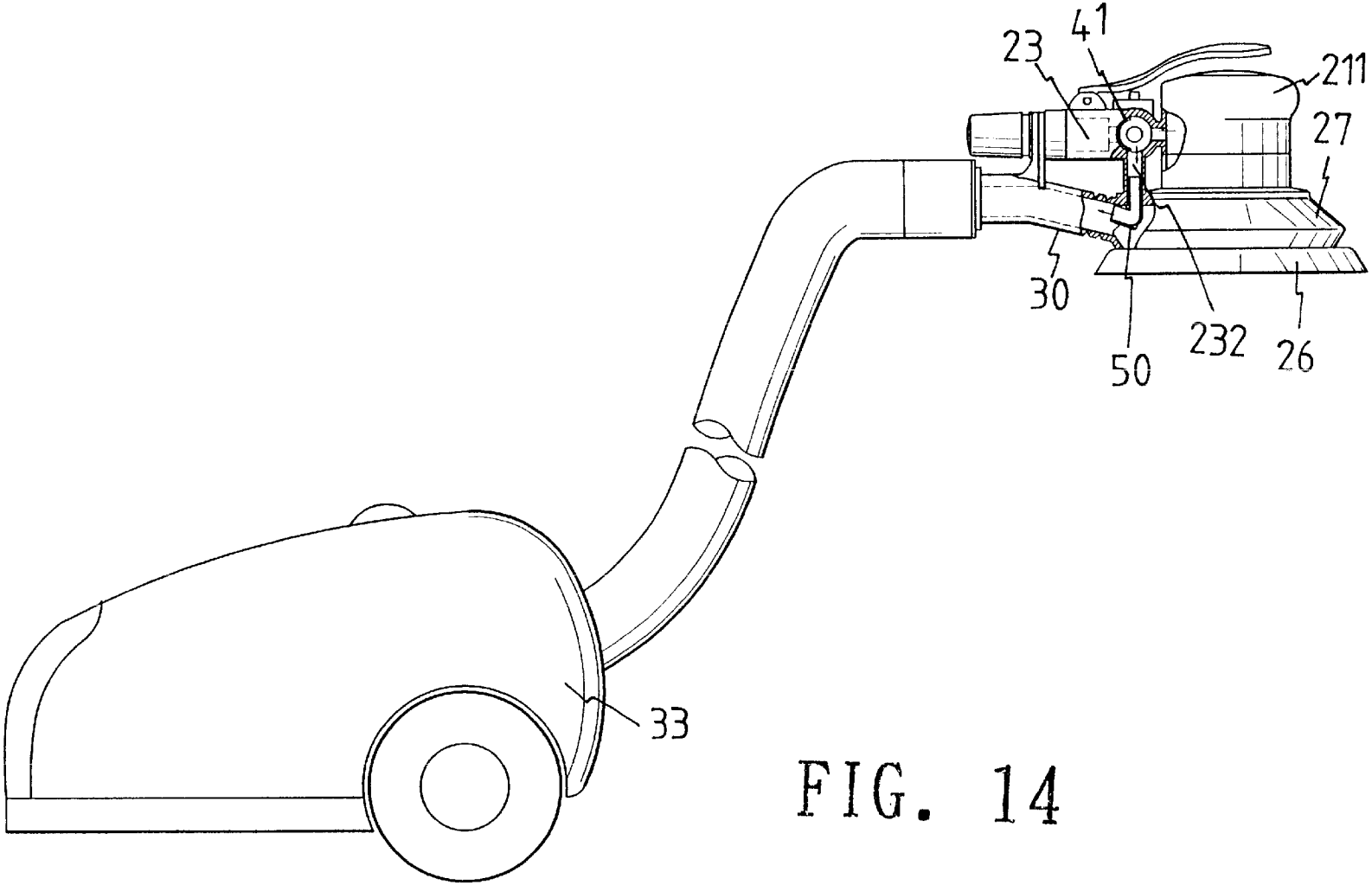
FIG. 14 is a cross sectional view to show a vacuum cleaner is connected to the collection tube wherein the control member is located to communicate the extension tube and an interior of the casing.
Figure 15:
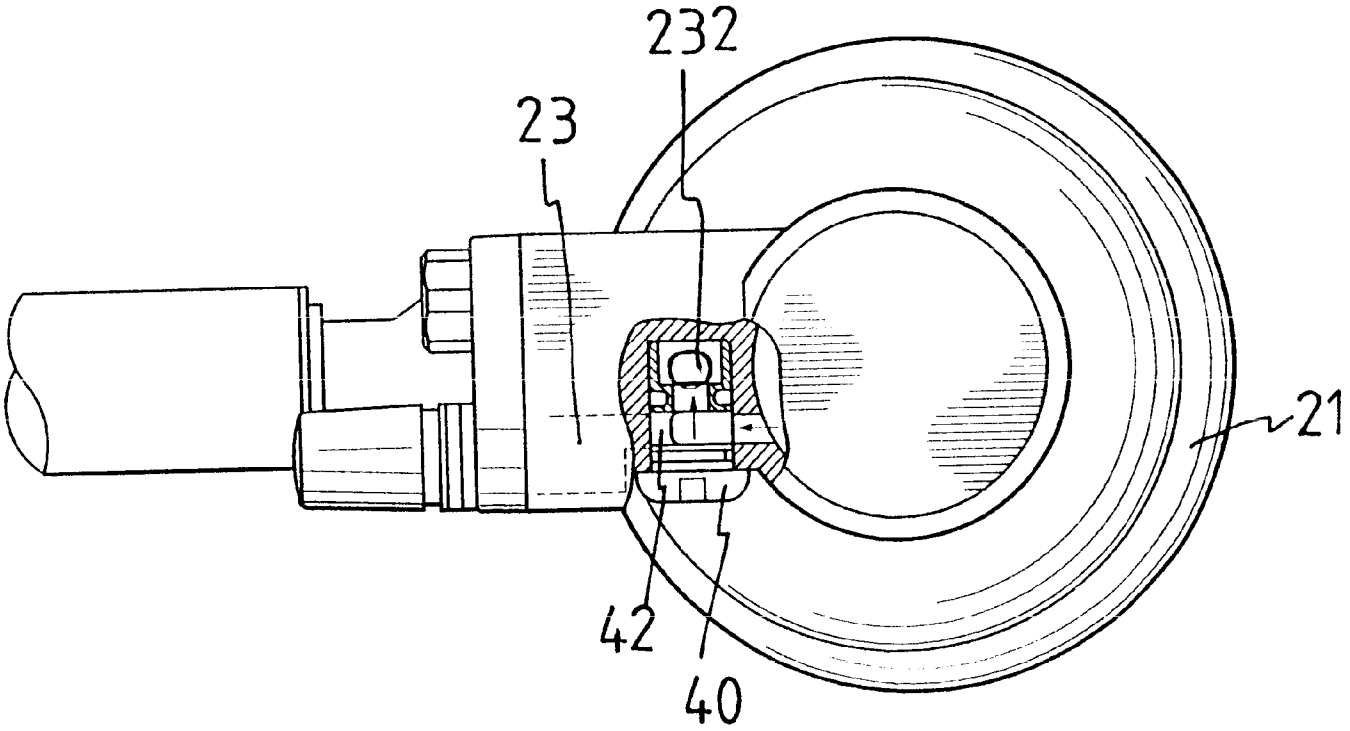
FIG. 15 is a cross sectional view to show the control member is located to communicate the extension tube and an interior of the casing as shown in FIG. 14.

A casing 21 is engaged with the annular cover 27 and receives the power assembly 24 in the casing 21. A hosing 210 extends from the casing 21 and an inlet 22 and an outlet 23 are respectively defined through the hosing 210 and communicate with the interior of the casing 21. A first passage 231 is defined transversely in the hosing 210 and communicates with the outlet. An extension tube 232 extends from the hosing 210 and communicates with the first passage 231 and the outlet 23. The extension tube 232 is engaged with the engaging recess 270 of the annular cover 27. A collection tube 30 is connected to the exhaust tube 271 so as to be connected a dust bag 31 as shown in FIG. 11 or a vacuum cleaner 33 as shown in FIG. 14.

A control valve 40 is rotatably received in the first passage 231 and has a first section 44 and a second section 42. A through hole 43 is defined radially through the first section 44 and a notch 41 is defined in an outer periphery of the second section 42. The first section 44 is located to block the extension tube 232 and the second section 42 is located to block the outlet 23.

Figure 6:
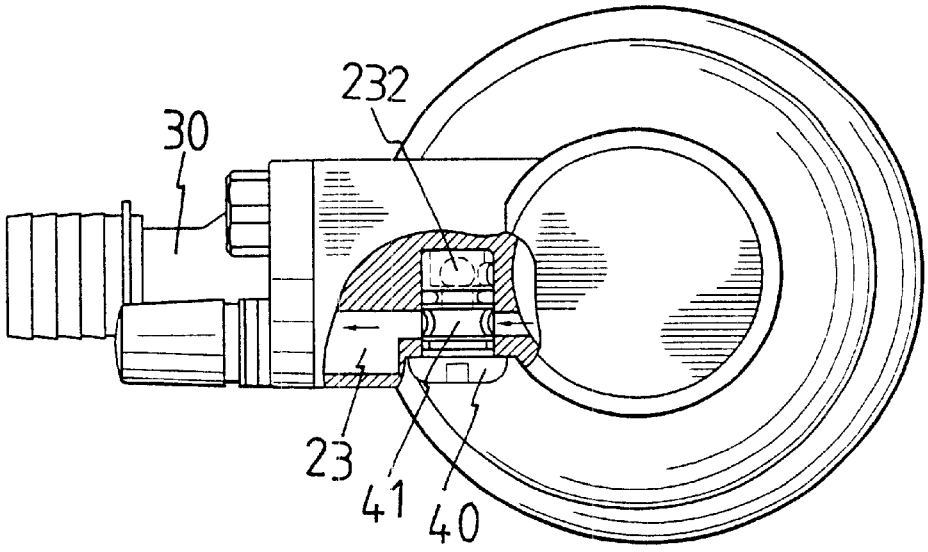
FIG. 6 is a top cross sectional view to show the control member is positioned to communicate the outlet and the annular cover.
Figure 7:
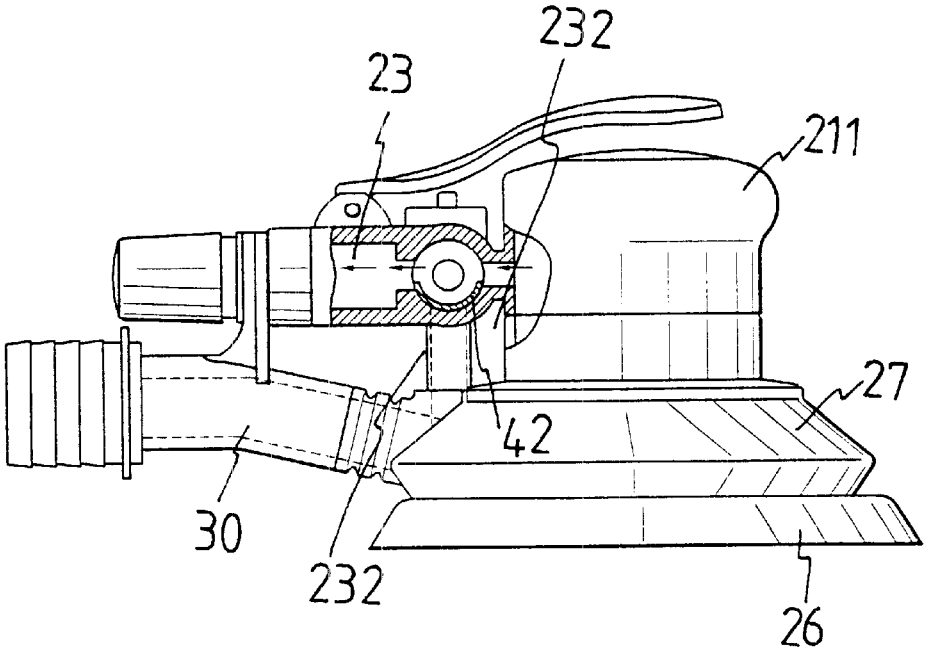
FIG. 7 is a side cross sectional view to show the situation as illustrated in FIG. 6.

FIGS. 6 and 7 show that when the sanding device is used to send the sanding powder in the annular cover 27 from the outlet 23, the second section 42 blocks the extension tube 232 so that the exhaust air flow passes through the notch 41 and flows out from the outlet 23.

Figure 8:
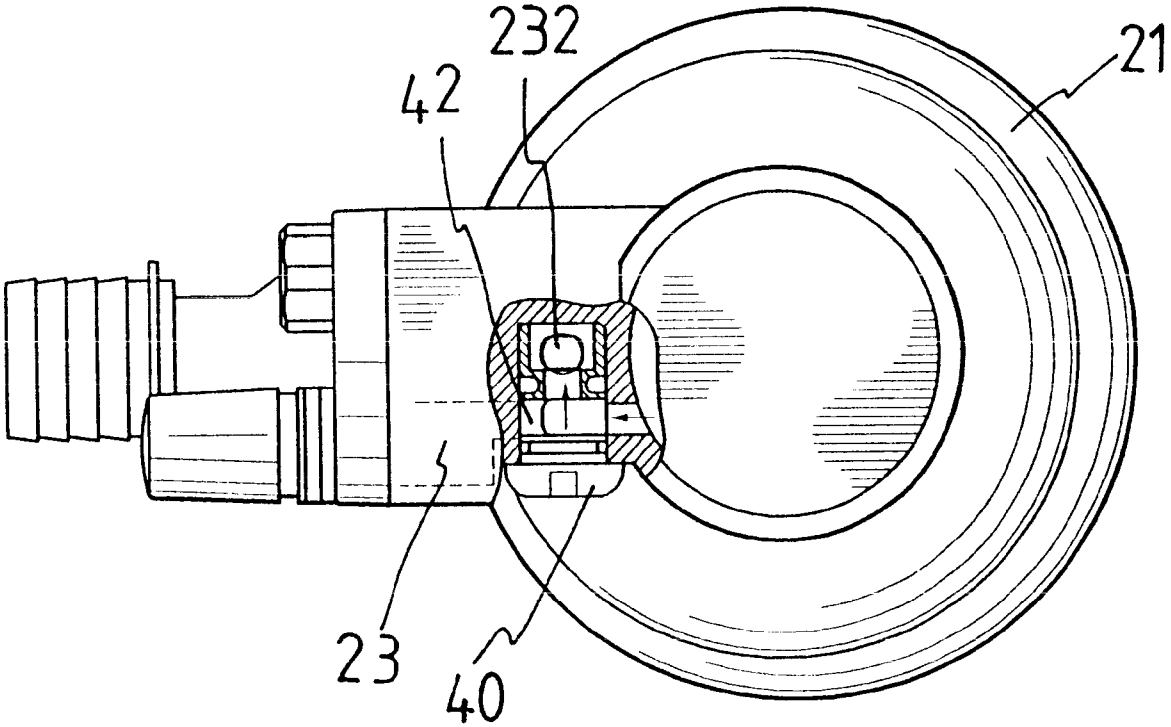
FIG. 8 is a top cross sectional view to show the control member is positioned to communicate the annular cover and the extension tube.
Figure 9:
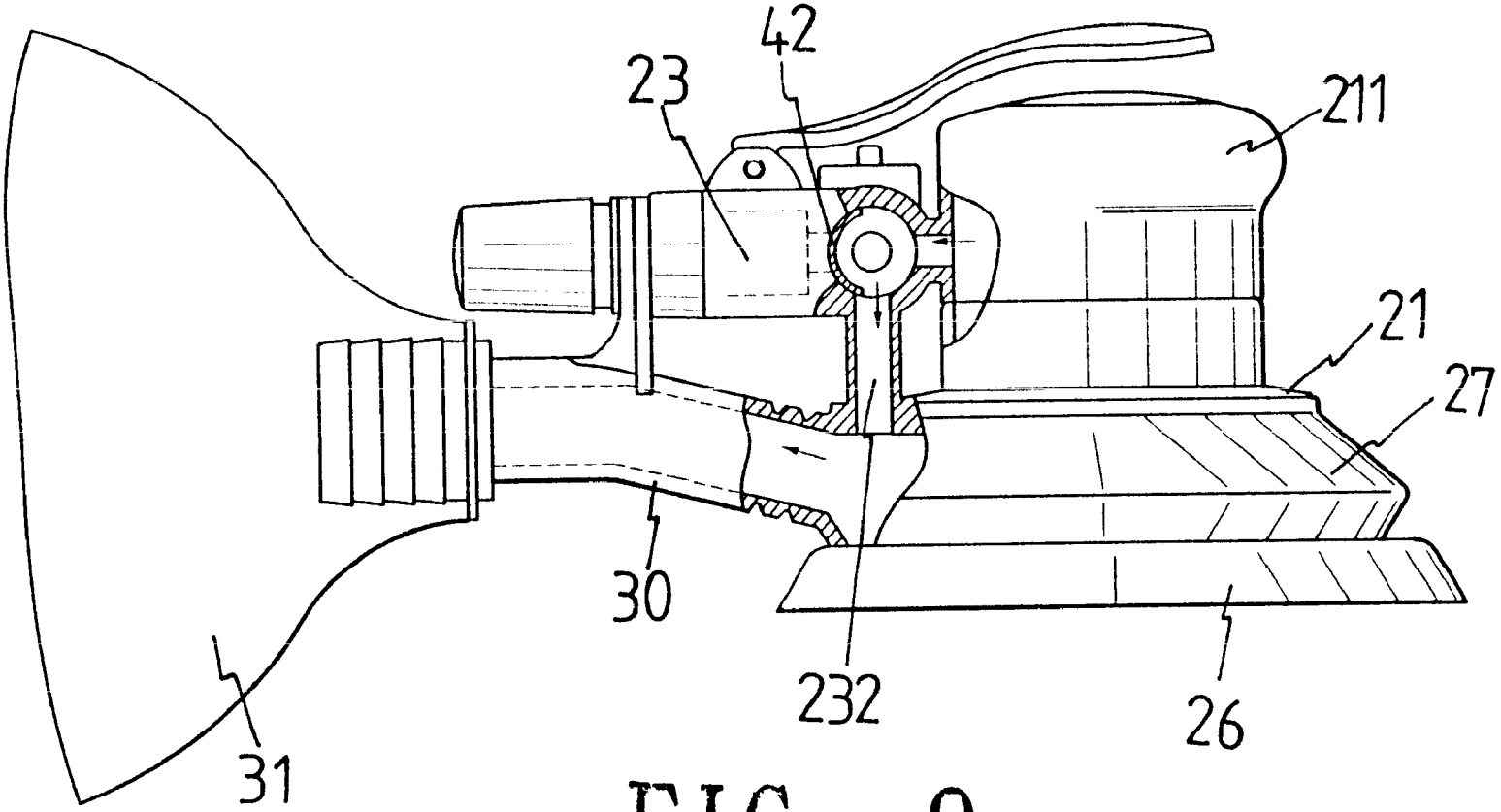
FIG. 9 is a side cross sectional view to show the situation as illustrated in FIG. 8.

FIGS. 8 and 9 show that when the sanding device is used to be cooperated with the dust bag 31 connected to the collection tube 30, the control member 40 is rotated to let the second section 42 block the outlet 23 and the exhaust air flow from the annular cover 27 is guided into the extension tube 232 and the sanding powder goes into the dust bag 31 via the dust bag 31.

Figure 10:
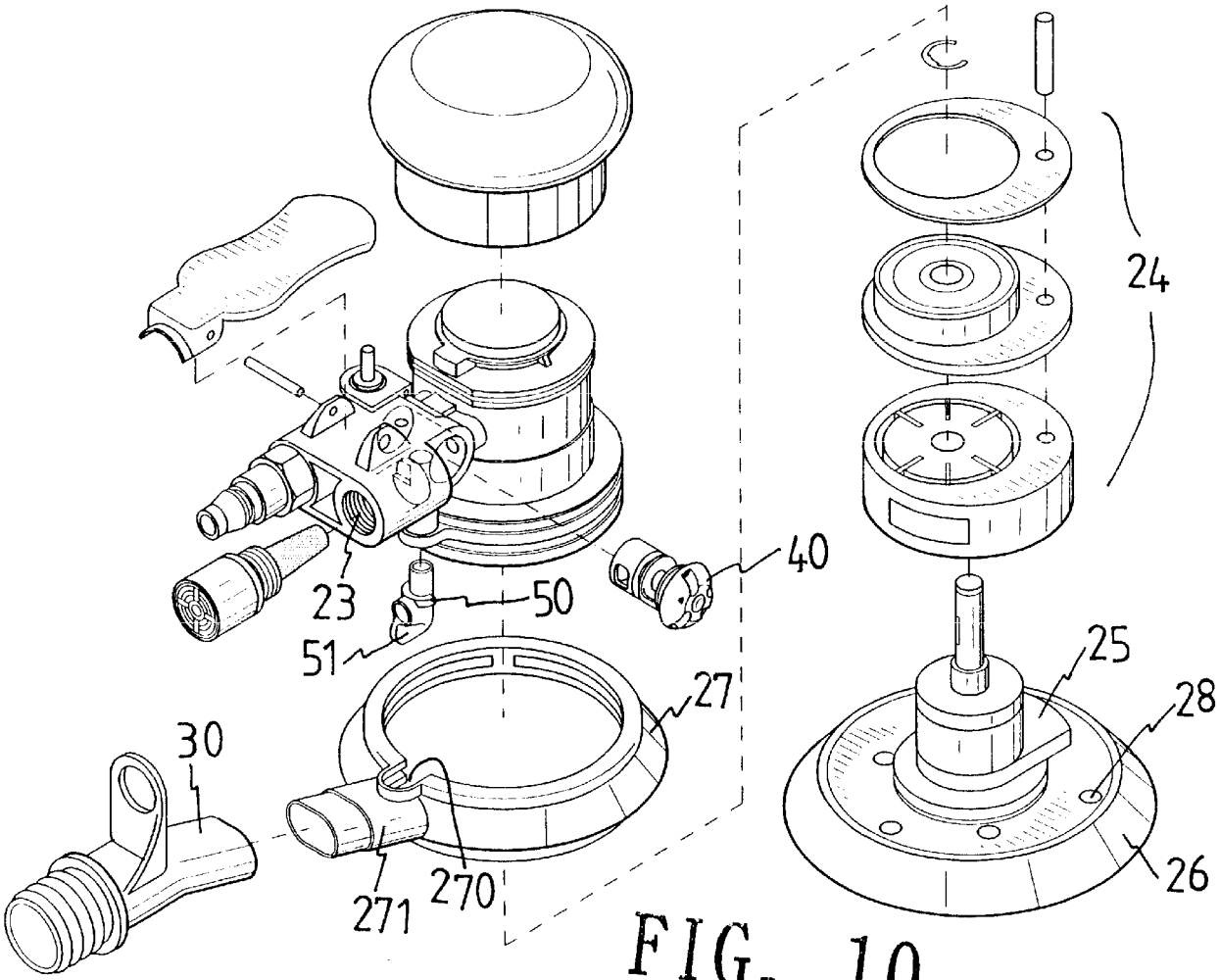
FIG. 10 is an exploded view to show another embodiment of the exhaust assembly of the present invention wherein a connection member is inserted in the extension tube.

FIGS. 10 and 11 show that an L-shaped connection member 50 which has a first end inserted in the extension tube 232 and a tunnel defined through the connection member 50. A second end of the connection member 50 communicates with the exhaust tube 271 of the annular cover 27. A tapered guide member 51 is connected to a lower end of the connection member 50 and located in the exhaust tube 271. The control member 50 is rotated to let the second section 42 block the outlet 23 and the air flow enters the exhaust tube 271 to suck sanding powder in the annular cover 27 to enter the exhaust tube 271 and to be collected in the dust bag 31. The guide member 51 guides the air flow from the interior of the annular cover 27 to the exhaust tube 271 and the collection tube 30.

FIGS. 12 to 15 show that the control member 40 is rotated to open the outlet 23 and block the extension tube 232, and a vacuum cleaner 33 is connected to the collection tube 30. Accordingly, the exhaust air flow goes out from the outlet 23 and the vacuum cleaner 33 also sucks the sanding powder in the annular cover 27.

The sanding device of the present invention can be easily change the functions by rotating the control member 40 to cooperate with a dust bag 31 or a vacuum cleaner 33 without changing any part or adding any part.

While we have shown and described various embodiments in accordance with the present invention, it should be clear to those skilled in the art that further embodiments may be made without departing from the scope of the present invention.

What is claimed is:

1. A sanding device comprising:

a sanding pad connected to an underside of a motor shaft balancer and a power assembly connected to a top of said motor shaft balancer, said sanding pad having holes defined therethrough;

an annular cover mounted to said motor shaft balancer and an exhaust tube extending from said annular cover, said sanding pad connected to said annular cover and said holes in said sanding pad communicating with an interior of said annular cover;

a casing engaged with said annular cover and a hosing extending from said casing, an inlet and an outlet respectively defined through said hosing and communicating with an interior of said casing, a first passage defined in said hosing and communicating with said outlet, an extension tube extending from said hosing and communicating with said first passage and said outlet, said extension tube engaged with said annular cover, and a control valve rotatably received in said first passage and having a first section and a second section, a through hole defined radially through said first section and a notch defined in an outer periphery of said second section, said first section located to block said extension tube and said second section located to block said outlet.

2. The device as claimed in claim 1 further comprising an L-shaped connection member which has a first end inserted in said extension tube and a tunnel defined through said connection member, a second end of said connection member communicating with said exhaust tube of said annular cover, a guide member connected to a lower end of said connection member and located in said exhaust tube.

3. The device as claimed in claim 2 wherein said guide member is a tapered member.

4. The device as claimed in claim 1 further comprising an engaging recess defined in an inner periphery of a top of said annular cover and communicating with said exhaust tube, said extension tube engaged with said engaging recess.

* * * * *